US005789847A

United States Patent [19]

Woodward et al.

[11] Patent Number: 5,789,847

[45] Date of Patent: *Aug. 4, 1998

[54] HIGH EFFICIENCY SEALED BEAM REFLECTOR LAMP WITH REFLECTIVE SURFACE OF HEAT TREATED SILVER

[75] Inventors: David R. Woodward, Morgantown; Walter A. Boyce; Jack R. Sheppard, both of Fairmont, all of W. Va.

[73] Assignee: Philips Electronics North America Corporation, New York, N.Y.

[ * ] Notice: The term of this patent shall not extend beyond the expiration date of Pat. No. 5,493,170.

[21] Appl. No.: 547,768

[22] Filed: Oct. 24, 1995

Related U.S. Application Data

[63] Continuation-in-part of Ser. No. 303,993, Sep. 9, 1994, Pat. No. 5,493,170.

[51] Int. Cl.[6] ..... H01J 5/16; F21V 7/00

[52] U.S. Cl. ..... 313/113; 313/114; 313/643; 313/578; 362/296

[58] Field of Search ..... 313/113, 114, 313/572, 578, 279, 281, 637, 635, 643; 362/296, 301, 302, 304, 305, 310, 341

[56] References Cited

U.S. PATENT DOCUMENTS

| | | | |
|---|---|---|---|
| 1,982,774 | 12/1934 | Winkler et al. | 88/1 |
| 2,123,706 | 7/1938 | Biggs | 91/70 |
| 2,181,293 | 11/1939 | Biggs | 313/114 X |
| 2,196,307 | 4/1940 | Hensel et al. | 75/173 |
| 2,217,228 | 10/1940 | Macksold | 91/70.1 |
| 2,619,430 | 11/1952 | Fink | 117/35 |
| 2,819,982 | 1/1958 | Westerveld et al. | 117/35 |
| 2,904,451 | 9/1959 | Scott et al. | 117/97 |
| 3,010,045 | 11/1961 | Plagge et al. | 313/113 |
| 3,174,067 | 3/1965 | Bahrs | 313/114 X |
| 3,974,413 | 8/1976 | Craig | 313/222 |
| 4,461,969 | 7/1984 | Walsh | 313/113 |
| 4,562,517 | 12/1985 | Pankin | 362/296 X |
| 4,728,848 | 3/1988 | Walsh | 313/113 X |
| 4,829,210 | 5/1989 | Benson et al. | 313/113 X |
| 4,959,583 | 9/1990 | Arsena et al. | 313/113 |
| 5,281,889 | 1/1994 | Fields et al. | 313/113 |
| 5,442,252 | 8/1995 | Golz | 313/113 X |
| 5,479,065 | 12/1995 | Sugimoto et al. | 313/113 |
| 5,493,170 | 2/1996 | Sheppard et al. | 313/113 |

FOREIGN PATENT DOCUMENTS

| | | | |
|---|---|---|---|
| 3605134A1 | 8/1987 | Germany | H01K 1/50 |
| 28881 | 4/1932 | Netherlands . | |
| 376122 | 7/1932 | United Kingdom . | |
| 420877 | 4/1934 | United Kingdom . | |
| 420575 | 12/1934 | United Kingdom . | |
| 838562 | 6/1960 | United Kingdom . | |

OTHER PUBLICATIONS

Pertwee, "Vacuum Evaporation of Silver," Chapter 33, General Electric Company, Cleveland, Ohio, pp. 455–457, Dec. 1975.

Chaston et al., "Some Effects of Oxygen in Silver and Silver Alloys," pp. 23–35, Dec. 1945.

Spura et al., "Thin Silver Film Coating For Increased Lamp Efficiency", Precious Metals 1981, pp. 259–264.

Moore, "The Influence of Surface Energy on Thermal Etching", Acta Metallurgica, vol. 6, Apr. 1958, pp. 293–304.

*Primary Examiner*—Ashok Patel
*Attorney, Agent, or Firm*—Walter M. Egbert, III

[57] ABSTRACT

A reflector lamp having a lens of vitreous material fused to a reflector body of vitreous material. An inner reflector surface of the reflector body includes a reflective coating having a first coating portion extending from the rim of the reflector body and a second coating portion extending from a location spaced from the rim towards a basal end of the reflector body. The second coating portion is a layer of heat-treated silver having a uniform, whitish non-metallic appearance and being diffusely reflective. The first coating portion is a layer of material other than silver, such as aluminum, having a higher resistance to damage by high heat in the rim area during fusing of the lens to the reflector body.

16 Claims, 2 Drawing Sheets

HIGH EFFICIENCY SEALED BEAM REFLECTOR LAMP WITH REFLECTIVE SURFACE OF HEAT TREATED SILVER

CROSS-REFERENCE TO RELATED APPLICATIONS

This is a continuation-in-part of U.S. application Ser. No. 08/303,993 filed Sep. 9, 1994 of Jack R. Sheppard et al. entitled "HIGH EFFICIENCY SEALED BEAM REFLECTOR LAMP" now U.S. Pat. No. 5,493,170.

BACKGROUND OF THE INVENTION

The invention relates to a reflector lamp comprising a reflector body of vitreous material having a longitudinal axis, a basal portion, a rim which defines a light-emitting opening of said reflector body, and an inner reflector surface which extends from the basal portion to the rim of the reflector, a lens of vitreous material fused to said rim, a light source arranged within said reflector body, and a reflective coating on said inner reflector surface.

Such a lamp is well known in the lighting industry and includes, for example, Parabolic Aluminized Reflector (PAR) lamps. In PAR lamps the reflective coating consists of aluminum and the light source is typically an incandescent filament or halogen capsule. The lens and the reflector body are typically a borosilicate hard glass and are fused to each other using a flame sealing process. As used herein, 'fused' refers to a sealed joint between the reflector body and the lens in which the vitreous material of each part is fused to the other by a high temperature process such as flame sealing, and excludes, for example, a joint where the two parts are bonded together with an adhesive, such as epoxy.

As part of a worldwide movement towards more energy efficient lighting, recent government legislation in the United States (commonly referred to as the national Energy Policy Act "EPACT") has mandated lamp efficacy values for many types of commonly used lamps including parabolic aluminized reflector (PAR) lamps. These minimum efficacy values will become effective in 1995 and only products meeting these efficacy levels will be allowed to be sold in the United States. The efficacy values for PAR-38 incandescent lamps have been established for various wattage ranges. For example, lamps of 51–66 W must achieve 11 lumens per Watt (LPW), lamps of 67–85 W must achieve 12.5 LPW, lamps of 86–115 W must achieve 14 LPW and lamps in the range 116–155 W must achieve 14.5 LPW.

PAR 38 lamps currently on the market with a reflective coating of aluminum and an incandescent filament have efficacies which will fail to meet the EPACT minimum efficacy standards. For example, the typical 150 W PAR 38 lamp provides only about 10–12 LPW (initial) and a 2000 hour life. It is possible to design a filament for a conventional aluminized reflector body which would meet the EPACT standards. However, such a filament would result in a greatly reduced lamp life (on the order of, for example, 800–1200 hours) which would not be commercially acceptable in view of the 1800–2000 hour lamp lifetimes now available in conventional PAR lamps.

SUMMARY OF THE INVENTION

Accordingly, it is an object of the invention to improve the luminous efficacy of PAR-type reflector lamps without reduction in lamp life.

The above object is accomplished in that a reflector lamp of the type described in the opening paragraph is characterized in that:

the reflective coating comprises a first reflective coating portion extending from said rim towards said basal portion and a second reflective coating portion which extends from an axial position spaced from said rim to said basal portion, and the second reflective coating portion consists essentially of silver and the first reflective coating portion consists essentially of a material other than silver.

It is known, for example from U.S. Pat. No. 2,123,706, that silver has a higher reflectivity than aluminum. However, one disadvantage is that silver has a higher cost than aluminum. Secondly, it is not straightforward to substitute silver in place of aluminum. During the lens-reflector fusing process, it is necessary to subject the lens and reflector to various temperature-time processes in order to produce a good, strong gas-tight seal between the two glass pieces and in order to produce a properly tempered lamp. When a silver coating is substituted for a conventional aluminum coating on the inside of the reflector, it is considerably damaged in the area of the rim when the lamp goes through the typical heating stages used to fuse the lens to the reflector body. The damaged area has a greatly reduced reflectivity, is a source of light scattering, and allows light to escape through the rear of the reflector body. The damaged area also is cosmetically unsightly for consumers because it can be seen from the exterior of the reflector, either through the reflector body, the lens, or both.

By the features according to the invention, the higher reflectivity of silver is employed to enhance luminous efficacy by using it in the critical reflecting areas of the basal portion behind the filament and the portions laterally surrounding the filament while its undesirable characteristic of susceptibility to damage during manufacturing is avoided by spacing it from the rim area which is subject to high heat. A more heat resistant, but less reflective metal, such as aluminum, is used in the high heat rim area. It was found that higher efficacies could be achieved with this arrangement than when the silver covered 100% of the surface area of the reflector body, even when the silver near the rim was over a layer of aluminum. The highest efficacies were achieved when the silver covered between about 40% and 65% of the area of the reflector surface.

According to a favorable embodiment of the invention, the first reflective material is aluminum and extends as a first coating layer completely between the rim and the basal portion and the silver material extends as a second coating layer disposed on the first, aluminum layer. This simplifies lamp manufacturing by employing a fully aluminized reflector which is already used in the lamp manufacturing process. The aluminized reflector then only needs to be provided with the silver coating on the portion axially spaced from the rim. This also has the advantage that the exterior of the reflector shows only one type of coating, which in the case of aluminum, consumers are already familiar with from conventional PAR lamps. Alternatively, it is also feasible to provide the aluminum coating on less than the entire reflector surface. However, this would require masking of the reflector for the aluminum coating also and the interface between the two different coatings would be seen from the exterior of the reflector body.

The silver portion or layer may have a highly reflective, mirror-like appearance, thus constituting a specular reflector surface. However, experiments have revealed that even-with the silver layer terminating at approximately 40% –60% of distance between the rim and basal end of the reflector body, that the silver layer may still have discolored parts depending, among others, on the sealing process and equipment used and the size of the reflector body. Essentially, various variables in the lamp making parts, equipment and process used for different lamps and by different lamp manufacturers may result in temperatures during sealing which result in erratic discoloration or hazing over parts of, or the entire area, of the silver layer. Consequently, the cosmetic appearance of the reflective surface, when viewed through the lens, and performance will be worse than with lamp, in which no discoloration of the silver layer is present.

According to another embodiment of the invention, the silver layer/portion is heat treated in an oven in the presence of oxygen. Instead of being specular, the heat treated silver layer is diffusely reflecting and has a whitish, non-metallic appearance. This is obtained in a simple manner by heating the reflector body at a controlled temperature in an oven after deposition of the silver material on the reflector body and prior to fusing of the lens to the rim of the reflector body. The controlled oven environment provides a uniform, reflective surface for the silver layer/portion which remains unchanged during the following lens fusing process. As compared to lamps having a corresponding specular silver layer, the diffusely reflecting silver layer provides a beam having a lower maximum beam candlepower and a corresponding broadening of the beam. This holds true for a comparison with a corresponding lamp having a conventional full aluminum reflector surface as well. The heat-treated silver provides a luminous efficacy which is less than a corresponding lamp with the specular silver layer/portion but which is significantly more than a corresponding lamp with the conventional full-aluminum only reflector surface. Accordingly, a partial, diffusely reflecting silver layer is also an attractive device for increasing the luminous efficacy of a reflector lamp without adversely affecting lamp life.

These and other advantageous features of the invention which further contribute to the efficacy of the reflector lamp will become apparent with reference to the following drawings and detailed description.

DESCRIPTION OF THE PREFERRED EMBODIMENTS

Figure 1:
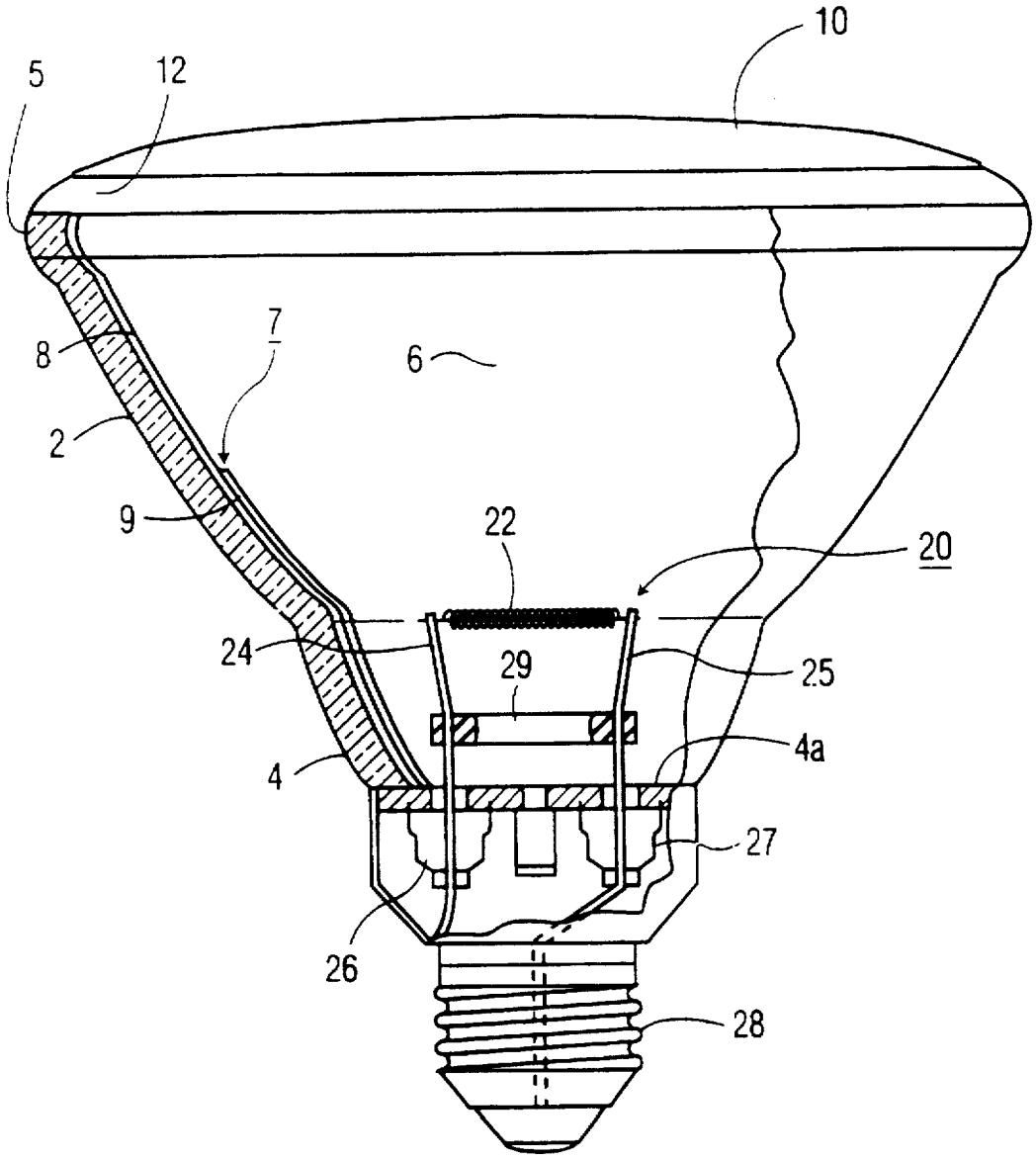
FIG. 1 illustrates a reflector lamp according to the invention, partly broken away and partly in cross-section.

FIG. 1 shows a PAR-type reflector lamp having a reflector body 2 and lens 10 of vitreous material, in this case borosilicate hardglass. The reflector body includes a basal portion 4, a rim 5 which defines a light-emitting opening of the reflector body, and an inner reflector surface 6 which extends from the neck portion to the rim of the reflector. In the lamp shown, the inner reflector surface is parabolic. A corresponding rim 12 of the lens is fused to the rim 5 of the reflector in a gas-tight manner.

A light source generally denoted as 20 is arranged within the reflector body. The light source includes an incandescent filament 22 supported by conductive filament supports 24, 25 which are braced together with an insulative brace 29. The filament supports are brazed to respective ferrules 26, 27 and connected to respective electrical contacts on a screw-type base 28 in a conventional fashion.

In contrast to many lamps which have several filament supports engaging the filament at multiple locations on the filament, in the lamp shown the filament supports 24, 25 support the filament at only two locations at the uncoiled tail or end portions thereof. It is desirable to minimize the number of support points because the supports may short-circuit adjacent filament turns. The supports also act as heat sinks causing the filament to be locally cooler at the support locations. Thus, fewer supports correspond to higher filament efficiency.

The sealed space enclosed by the reflector body and lens includes a gas fill consisting of 80% krypton and 20% nitrogen at a pressure of about 1 atmosphere. This gas mixture has a higher molecular weight than the conventional 50% argon, 50% nitrogen fill typically used in PAR lamps, which means it is less mobile and provides less convective cooling of the filament than the conventional mixture. It should be noted that further increasing the percentage of krypton in the fill above 80% greatly increases the chance of arcing between the filament supports. Accordingly, for a krypton-nitrogen fill, a ratio of about 80% Kr to 20% $N_2$ appears to be optimum. Other gas mixtures with higher molecular weight than the 50% argon, 50% nitrogen mixture would also be suitable, such as for example a mixture of 60% argon, 10% krypton, and 30% nitrogen.

The inner reflector surface 6 includes a reflective coating generally denoted as 7 which extends from the surface 4a of the basal portion near the eyelets 26, 27 to the rim 5 of the reflector for directing light emitted by the filament 22 out through the lens 10 with a desired beam pattern. In commercially available PAR lamps, the reflective coating is typically a single layer of aluminum, which is deposited by well known chemical or vapor deposition techniques with a thickness of about (0.1–0.3 μm). As previously noted, the conventional PAR configuration has an efficacy which is well below the mandated guidelines, for example 10–12 initial LPW (at 2000 hour rated life) verses the mandated 14.5 LPW for a 150 W lamp.

While the above measures regarding filament supports and gas fill serve to increase lamp efficacy, the increase is not enough to meet the mandated efficacy guidelines. Accordingly, other areas of lamp design such as the reflective coating must be looked at.

Instead of aluminum, complex multilayer dielectric coatings, for example dichroic, may be used which have a much higher reflectivity than aluminum., These have the severe drawback, however, that they are very expensive to manufacture. Other options include the use of other metallic coatings which can be applied in the same manner that aluminum is applied, i.e. vapor or chemical deposition, to maintain a low lamp cost. One suitable material is silver which has a reflectivity which is about 8% higher than aluminum. However, U.S. Pat. No. 3,010,045 (Plagge et al) teaches that silver cannot be used in a lamp in which the hardglass lens is fused to the hardglass reflector body. Plagge describes that a silver coating will discolor or peel off at the relatively high temperatures that portions of the reflecting surface are subjected to during fusion of the lens to the rim of the reflector body. This was confirmed in experiments conducted by the present inventors, in which the temperature of the seal area during fusing was found to be at about 1100° C. The silver peeled and was otherwise damaged over an area extending over an axial length from the seal of about 10–20 mm.

Plagge opted for a completely different envelope construction in which an epoxy is used to seal the lens to the reflector, thereby avoiding the application of gas flames and the resulting high temperature at the lens/rim area. An epoxy seal has numerous disadvantages, however, including long curing times, variations in seal strength due to variations in the epoxy and environmental (temperature, humidity) conditions during curing, the additional measures which must be taken to ensure that the vapors given off by the epoxy are removed from the finished lamp, and a seal quality which is generally lower than that of the conventional fused glass seal. Epoxy seals have been known to fail in situations where the lamp is subjected to high heat conditions, such as in high-hat fixtures. Thus, epoxy seals do not provide a sufficiently gas-tight seal to be used with a bare filament and are predominantly used commercially in lamps having a halogen burner as the light source in which the filament is enclosed in a separate gas-tight capsule. It is desirable to maintain the conventional fused seal structure for reasons of cost, durability and simplicity, especially in lamps with an incandescent filament not enclosed in a separate gas-tight capsule.

In the lamp according to the invention, the inner reflective coating 7 includes a first reflective portion 8 of aluminum extending from the rim towards the basal portion 4 and a second reflective portion 9 of specular silver beginning at a position spaced from the rim and extending to the basal area of the reflector. In the lamp shown in FIG. 1, the aluminum is coated in a first layer which extends over the entire reflector surface and the silver portion 9 is a second layer coated over the aluminum. This has the advantage that a reflector body having a full aluminum layer, which is already used in the production of conventional PAR lamps, is utilized, which then merely must have its portion remote from the rim coated with a layer of silver. Thus, minimal changes in production are necessary. From the exterior, the fully coated aluminum reflector has a uniform appearance, and is exactly the same as the conventional lamp, which is important for consumer acceptance.

Figure 2:
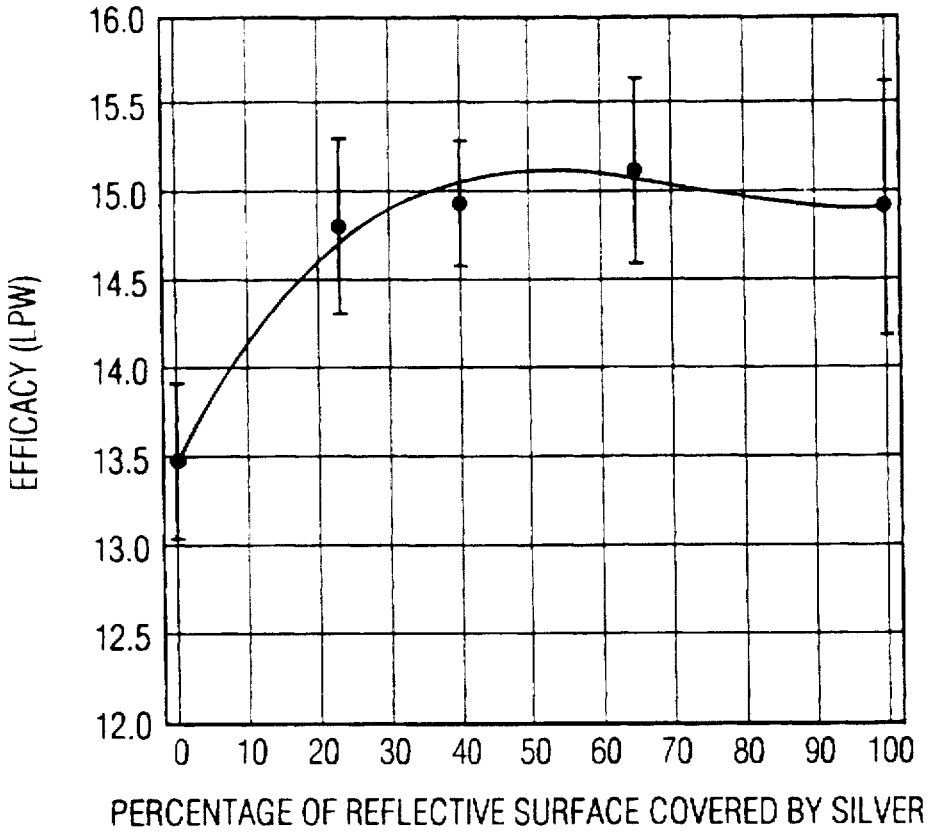
FIG. 2 is a graph of luminous efficacy versus the percentage of reflective surface covered by silver for a 110 W incandescent PAR lamp.

FIG. 2 shows lamp efficacy in relation to the percentage of reflective surface area covered by specular silver for a 110 W lamp according to FIG. 1 having a full base layer of aluminum. The lamp had a 120 V coil and a filling of 80% Kr/20% $N_2$at 600 Torr. It was a surprise to find that the efficacy was actually lower when a reflector body having silver over the entire surface area (100%) was flame sealed to a lens than when a reflector body was used having an axial portion near the rim coated only with aluminum. As shown in FIG. 2, peak efficacy is achieved when the silver covers between about 40% and about 65% of the surface area of the reflector. This corresponds to a relative height between the bottom 4*a* of the reflector surface and the rim 5 of 40% and 60%, respectively. This effect is believed to be due to the observation that when the area near the rim has a layer of silver over a layer of aluminum substantially more discoloration, appearing as dull, brown to blackish-brown areas, is present after flame sealing than when only aluminum is present in this region. The greater total discolored area for the silver/aluminum layers is believed to absorb more light than the aluminum layer only, which has less discoloration.

Table I lists the luminous efficacy for various lamp configurations for a PAR 38 lamp. For lamps with "half silver over aluminum" the silver covered 50% of the surface area of the reflector and was specular, i.e. mirror-like. The efficacies are shown for a filament coil rated at 120V, 2000 hour life.

TABLE 1

| | | EPACT | | | | With 2000 Hr. design life | |
|---|---|---|---|---|---|---|---|
| ID # | Wattage | Minimum LPW | Reflective Coating | Fill Gas @ 600 Torr | Efficacy (LPW) | % Gain due to Reflector | % Gain due to Gas |
| 1 | 110 | 14 | Aluminum | 80% Kr 20% N2 | 13.16 | | |
| 2 | 110 | 14 | Half silver over aluminum | 80% Kr 20% N2 | 14.81 | +12.53% | |
| 3 | 65 | 11 | Aluminum | 80% Kr 20% N2 | 11.71 | | |
| 4 | 65 | 11 | Half silver over aluminum | 80% Kr 20% N2 | 12.80 | +9.3% | |
| 5 | 150 | 14.5 | Aluminum | 80% Kr 20% N2 | 13.20 | | |
| 6 | 150 | 14.5 | Half silver over aluminum | 80% Kr 20% N2 | 14.70 | +11.3% (6-5) | +10.94% (6-7) |
| 7 | 150 | 14.5 | Half silver over aluminum | 50% Ar 50% N2 | 13.25 | | |
| 8 | 90W Halogen | 14 | Aluminum | 50% Ar 50% N2 | 13.30 | | |
| 9 | 90W Halogen | 14 | Half silver over aluminum | 50% Ar 50% N2 | 14.30 | +7.5% | |
| 10 | 150 | 14.5 | Aluminum | 50% Ar 50% N2 | 12.32 | | |
| 11 | 150 | 14.5 | Aluminum | 80% Kr 20% N2 | 13.33 | | +8.3% |

Table I shows that by using the reflective coating according to the invention, the luminous efficacy for a 110 W PAR 38 lamp (with an 80% Kr/20% $N_2$ fill) is increased from 13.16 LPW (lamp 1) to 14.81 LPW (lamp 2), which is above the minimum mandated efficacy requirement of 14 LPW. Similarly, for the 150 W PAR 38 lamp, the efficacy is increased from about 13.2 LPW (lamp 5) to 14.7 LPW (lamp 6), also above the minimum mandated efficacy of 14.5. The 65 W lamps showed an increase from 11.71 LPW (lamp 3) to 12.8 LPW (lamp 4). The increase due to the use of the partially silver coated reflector was 12.5%, 11.3% and 9.3% for the 110 W, 159 W and 65 W lamps, respectively. The increase in efficacy due to the Kr/$N_2$ gas fill verses the conventional Ar/$N_2$ fill is illustrated between the two silver coated lamps 6–7 (10.94%) and between lamps 10–11 (8.3%), which had only an aluminum coating. Lamps 8 and 9 contained the same 90 W halogen burner and showed an increase of 7.5%, raising the efficacy from 13.3 LPW to 14.3 LPW, above the mandated 14 LPW. It is believed the efficacy increase would have been higher for lamps 8–9 had the height of the silver layer been optimized for the height and vertical orientation of the filament in the burner, which was different than for the other lamps which had a bare, horizontal filament.

In the lamps according to the above-described embodiment a significant increase in luminous efficacy was obtained which enabled the lamps to meet the EPACT standards, while maintaining a fused lens seal construction and without reducing the lamp life below that which is common and has been commercially established for conventional PAR lamps.

In another embodiment of the invention, after depositing the silver in the region shown in FIG. 1, the reflector body was heated to a temperature of 450° C. for ten minutes in an oven in the presence of air. This caused the silver layer 2 to have a whitish, non-metallic, diffusely reflective appearance rather than the metallic, specular appearance of the first embodiment. The oven-baking had no effect on the aluminum layer. The appearance of the heat-treated silver layer was unaffected by the following flame-sealing process used for fusing the lens to the reflector body.

Table II shows the test results for a comparison test between lamps having (i) an all aluminum reflector surface, (ii) heat-treated reflector surface, and (iii) a specular reflector surface 2. Each of the lamps employed a UT4 reflector body, 75 W regular coils (with a center support) and a fill gas of 50% argon/50% nitrogen. The first group were flood lamps (lens=F) and the second group were spot lamps (lens=S). The silver covered the same surface area percentage for both the heat-treated (diffuse) and non-heat-treated (specular) samples within each group.

and the krypton fill as used in the lamps in Table I which did meet the EPACT standards. However, Table II does serve to illustrate that the heat-treated silver layer provides a substantial increase in luminous efficacy and is a significant feature which can be used along with other good design features, such as filament structure/support and gas fill, to attain the EPACT standards.

From a performance standpoint, the aluminum need not extend over the entire axial length of the reflector surface, but need only extend from the rim up to the axial location at which the silver begins. The interface between the two different reflective materials would then be visible from the exterior, however.

The advantages of the two-material reflector surface for a fused lens design are applicable to lamps with other light sources as well. Thus, reflector lamps in which the light source is a halogen capsule or an HID arc tube, such as a metal halide or high pressure sodium arc tube, would likewise have corresponding efficacy increases with this type of reflective surface. Additionally, the percentage of the area of the reflector surface which is silvered may be varied.

While there has been described what are considered to be the preferred features of the invention, those of ordinary skill in the art will appreciate that various modifications are possible within the scope of the appended claims. For example, although aluminum was found to provide the best performance in the lens-rim seal area, other materials such as aluminum alloys may be used which have similar resistance to break down in this high-temperature region during manufacture. Accordingly, the description is considered to be illustrative only and not limiting.

What is claimed is:

1. A reflector lamp, comprising:

a reflector body of vitreous material having a longitudinal axis, said reflector body including a basal portion, a rim which defines a light-emitting opening of said reflector body, and an inner reflector surface which extends from the neck portion to the rim of the reflector, a lens of vitreous material fused to said rim, a light source arranged within said reflector body, and a reflective coating on said inner reflector surface, characterized in that:

said reflective coating comprises a first coating portion extending from said rim towards said neck portion and a second coating portion which extends from an axial position spaced from said rim to said basal portion, said second coating portion consists essentially of heat-treated silver having a diffusely reflective surface and said first coating portion consists essentially of a first material other than silver.

2. A reflector lamp according to claim 1, wherein said first coating portion is a first layer of said first material which extends completely between said rim and said basal portion

TABLE II

| MATERIAL | HEAT-TREATED | LENS | SAMPLE SIZE | EFFICACY LPW | SIGMA LPW | LPW GAIN Rel. Al | MBCP | SIGMA | L-R | SIGMA | U-D | SIGMA |
|---|---|---|---|---|---|---|---|---|---|---|---|---|
| Silver/Aluminum | N | F | 10 | 10.73 | 0.22 | 10.4 | 2155 | 87 | 30.9 | 0.8 | 28.9 | 1 |
| Aluminum | N/A | F | 8 | 9.72 | 0.4 | — | 2052.5 | 125 | 30.5 | 0.8 | 29.1 | 0.7 |
| Silver/Aluminum | Y | F | 10 | 10.18 | 0.33 | 4.7 | 1288 | 150 | 34.7 | 2 | 33.3 | 1.9 |
| Silver/Aluminum | N | S | 11 | 10.62 | 0.17 | 7.1 | 5849 | 848 | 13.6 | 1.9 | 11.8 | 1.4 |
| Aluminum | N/A | S | 8 | 9.92 | 0.13 | — | 7096 | 620 | 12.3 | 0.9 | 10.8 | 1 |
| Silver/Aluminum | Y | S | 12 | 10.33 | 0.43 | 4.1 | 3887 | 701 | 13.8 | 3 | 12.3 | 2.7 |

While the corresponding efficacy was higher for the samples with the specular silver layer than with the heat-treated silver layer (10.73 vs. 10.18 and 10.62 vs. 10.33), the samples with the heat-treated silver layer showed substantial gains in efficacy over the conventional (aluminum only) lamps (10.18 vs. 9.72 and 10.33 vs. 9.92) The average LPW gain for the heat-treated silver/aluminum reflector surface relative to the conventional all-aluminum reflector surface was 4.43%, which is a significant gain.

Table II also illustrates how the heat-treated silver layer, by its diffusely reflecting characteristic, broadens the beam relative to both the aluminum-only and specular silver reflectors (compare the left-right "L-R" and up-down "U-D" figures) and reduces the maximum beam candle power ("MBCP"). For spot lamps, where a narrow beam is desired, this effect can be counteracted by an appropriate lens. This broadening is advantageous, however, for flood lamps where a broad, more homogeneous beam is desired.

The samples in Table II do not meet the minimum EPACT standards because they did not include a high efficiency coil and said second coating portion is a layer of said heat-treated silver disposed on said first material.

3. A reflector lamp according to claim 2, wherein said first material consists essentially of aluminum.

4. A reflector lamp according to claim 3, wherein said light source is an incandescent filament and the space enclosed by said reflector body and said lens includes a gas fill consisting essentially of krypton and nitrogen in ratio of about 80% krypton to about 20% nitrogen.

5. A reflector lamp according to claim 4, wherein said layer of silver covers between about 40% and about 65% of the area of the reflector surface.

6. A reflector lamp according to claim 1, wherein said first material consists essentially of aluminum.

7. A reflector lamp according to claim 1, wherein said light source is an incandescent filament and the space enclosed by said reflector body and said rim includes a gas fill of consisting essentially of krypton and nitrogen in a ratio of about 80% krypton to about 20% nitrogen.

8. A reflector lamp according to claim 1, wherein said heat-treated silver covers between about 40% and about 65% of the area of the reflector surface.

9. A reflector lamp, comprising:

a reflector body of borosilicate hard glass having a longitudinal axis, said reflector body including a basal portion, a rim which defines a light-emitting opening of said reflector body, an inner reflector surface which extends from said basal portion to said rim of said reflector and includes a parabolic portion, and a reflective coating on said inner reflector surface comprising a layer of aluminum extending from said rim towards said basal portion and a layer of heat-treated silver which extends from an axial position spaced from said rim to said basal portion, said layer of heat-treated silver having a uniform, whitish, non-metallic appearance and being diffusely reflecting;

a lens of borosilicate hard glass fused in a gas-tight manner to said rim of said reflector body; and a light source arranged within said reflector body.

10. A reflector lamp according to claim 9, wherein said layer of aluminum extends completely between said rim and said basal portion, and said layer of silver is disposed on said layer of aluminum and covers between about 40% and about 65% of the area of the reflector surface.

11. A reflector lamp according to claim 10, further comprising a gas fill consisting of about 80% Krypton and 20% Nitrogen within said reflector body, and wherein said light source is an incandescent filament.

12. A reflector lamp according to claim 11, wherein said incandescent filament has a rating of about 150 W, and said lamp has a luminous efficacy of greater than 14.5 LPW.

13. A reflector lamp according to claim 12, further comprising means for supporting said filament at only two points thereon.

14. A reflector lamp according to claim 11, wherein said incandescent filament has a rating of about 110 W, and said lamp has a luminous efficacy of greater than 14 LPW.

15. A reflector lamp according to claim 14, further comprising means for supporting said filament at only two points thereon.

16. A reflector for a reflector lamp, said reflector comprising:

a body of vitreous material having a longitudinal axis, said body including a basal portion, a rim which defines a light-emitting opening of said body, and an inner reflector surface which extends from the neck portion to the rim of the body; and a reflective coating on said inner reflector surface, said reflective coating comprising silver having a diffusely reflective surface and a whitish, non-metallic appearance.

* * * * *